US007233894B2

(12) United States Patent
Sorin

(10) Patent No.: US 7,233,894 B2
(45) Date of Patent: Jun. 19, 2007

(54) LOW-FREQUENCY BAND NOISE DETECTION

(75) Inventor: Alexander Sorin, Haifa (IL)

(73) Assignee: International Business Machines Corporation, Armonk, NY (US)

( * ) Notice: Subject to any disclaimer, the term of this patent is extended or adjusted under 35 U.S.C. 154(b) by 857 days.

(21) Appl. No.: 10/373,258

(22) Filed: Feb. 24, 2003

(65) Prior Publication Data

US 2004/0167773 A1 Aug. 26, 2004

(51) Int. Cl.
*G10L 11/04* (2006.01)

(52) U.S. Cl. ..... 704/207; 704/208; 704/205; 704/226

(58) Field of Classification Search ..... 704/207, 704/208, 226
See application file for complete search history.

(56) References Cited

U.S. PATENT DOCUMENTS 4,384,335 A * 5/1983 Duifhuis et al. ..... 704/207
5,757,937 A * 5/1998 Itoh et al. ..... 381/94.3
6,081,777 A * 6/2000 Grabb ..... 704/220
6,587,816 B1 * 7/2003 Chazan et al. ..... 704/207
7,043,424 B2 * 5/2006 Chen et al. ..... 704/207
2002/0128830 A1 * 9/2002 Kanazawa et al. ..... 704/226
2002/0156623 A1 * 10/2002 Yoshida ..... 704/226
2002/0165711 A1 * 11/2002 Boland ..... 704/231
2004/0078199 A1 * 4/2004 Kremer et al. ..... 704/233
2004/0078200 A1 * 4/2004 Alves ..... 704/233
2004/0102967 A1 * 5/2004 Furuta et al. ..... 704/226
2005/0108006 A1 * 5/2005 Jurd et al. ..... 704/212

* cited by examiner

*Primary Examiner*—Richemond Dorvil
*Assistant Examiner*—Qi Han
(74) *Attorney, Agent, or Firm*—Suzanne Erez

(57) ABSTRACT

A pitch estimation system including a low-frequency band noise detector (LBND) operative to detect the presence of low-frequency band noise in a first audio frame, a frequency-domain pitch estimator operative to calculate a pitch estimation of a second audio frame from at least one spectral peak in the second audio frame, and a pitch estimator controller operative to cause the pitch estimator to exclude from the spectrum of the second audio frame at least one low-frequency spectral peak below a predefined threshold where low-frequency band noise is present in the first audio frame.

25 Claims, 10 Drawing Sheets

LOW-FREQUENCY BAND NOISE DETECTION

FIELD OF THE INVENTION

The present invention relates to speech processing in general, and more particularly to pitch estimation of speech segments in the presence of low-frequency band noise.

BACKGROUND OF THE INVENTION

Pitch estimation in speech processing can be used to distinguish between voiced and unvoiced speech segments and to represent the tone of voiced speech. Since voiced speech can be approximated using a periodic signal, pitch may be estimated by measuring the signal period or its inverse, which is referred to as the fundamental frequency or pitch frequency. Where a periodic signal cannot be used to approximate a speech segment, the speech segment may be designated as unvoiced.

A variety of techniques have been developed for pitch estimation in both the time domain and the frequency domain. While both time-domain and frequency-domain methods of pitch determination are subject to instability and error, and accurate pitch determination is computationally intensive, frequency-domain methods are generally more tolerant with respect to the deviation of real speech data from the exact periodic model.

The Fourier transform of a periodic signal, such as voiced speech, has the form of a train of impulses, or peaks, in the frequency domain. This impulse train corresponds to the line spectrum of the signal, which can be represented as a sequence $\{(a_i,\theta_i)\}$, where $\theta_i$ are the frequencies of the peaks, and $a_i$ are the respective complex-valued line spectral amplitudes. To determine whether a given segment of a speech signal is voiced or unvoiced, and to calculate the pitch if the segment is voiced, the time-domain signal is first multiplied by a finite smooth window. The Fourier transform of the windowed signal is then given by $$X(\theta) = \sum_k a_k W(\theta - \theta_k),$$

where $W(\theta)$ is the Fourier transform of the window. Frequency-domain pitch estimation is typically based on analyzing the locations and amplitudes of the peaks in the transformed signal $X(\theta)$.

Given any pitch frequency, the line spectrum corresponding to that pitch frequency could contain line spectral components at multiples of that frequency only. It therefore follows that any frequency appearing in the line spectrum should be a multiple of the pitch frequency. Consequently, pitch frequency could be found as the maximal integer divider of the frequencies of spectral peaks appearing in the transformed signal. However, the presence of background noise and other deviations from the periodic model causes spectral peaks to move away from their exact prescribed locations, and spurious spectral peaks to appear at unpredictable locations as well.

It follows from the periodic model that changing of pitch frequency results in relatively minor changes in the low frequency spectral line locations and relatively significant deviations of the high frequency spectral line locations. Consequently, low frequency spectral peaks have greater influence on pitch estimation than do high frequency spectral peaks. For this reason, the accuracy of frequency-domain pitch estimation deteriorates significantly in the presence of low-frequency band noise. Low-frequency band noise is often present in the passenger compartment of a moving or idling automobile, thus severely limiting the applicability of known frequency-domain pitch estimation methods in mobile environments.

SUMMARY OF THE INVENTION

The present invention provides for low-frequency band noise detection and compensation in support of frequency-domain pitch estimation of speech segments. A low-frequency band noise detector is provided, and low-frequency spectral peaks below a predefined threshold are excluded from frequency-domain pitch estimation calculations only if low-frequency band noise is detected.

In one aspect of the present invention a pitch estimation system is provided including a low-frequency band noise detector (LBND) operative to detect the presence of low-frequency band noise in a first audio frame, a frequency-domain pitch estimator operative to calculate a pitch estimation of a second audio frame from at least one spectral peak in the second audio frame, and a pitch estimator controller operative to cause the pitch estimator to exclude from the spectrum of the second audio frame at least one low-frequency spectral peak located below a predefined frequency threshold where low-frequency band noise is present in the first audio frame.

In another aspect of the present invention the LBND is operative to determine the spectrum of the first audio frame, calculate a measure $R_{curr}$ of the relative spectral components level in the frequency band $[0, F_c]$ of the first audio frame, where $F_c$ is a predefined threshold value, calculate an integrative measure R of the relative spectral components level in the frequency band $[0, F_c]$ of a plurality of audio frames from the $R_{curr}$ values of each of the plurality of audio frames, and determine that low-frequency band noise is present if $R>R_0$, where $R_0$ is a predefined threshold value.

In another aspect of the present invention the predefined threshold value is between about 270 Hz and about 330 Hz.

In another aspect of the present invention the predefined threshold value is about 300 Hz.

In another aspect of the present invention the predefined threshold value $F_c$ is between about 330 Hz and about 430 Hz.

In another aspect of the present invention the predefined threshold value $F_c$ is about 380 Hz.

In another aspect of the present invention the integrative measure R is calculated using the formula $R \leftarrow F(R, R_{curr})$.

In another aspect of the present invention the first audio frame is a non-speech frame.

In another aspect of the present invention the second audio frame is a speech frame.

In another aspect of the present invention the first audio frame precedes the second audio frame.

In another aspect of the present invention the system further includes a voice activity detector (VAD) operative to detect whether the first audio frame is a speech frame or a non-speech frame, and where the LBND is operative where the first audio frame is a non-speech frame.

In another aspect of the present invention a pitch estimation method is provided including detecting the presence of low-frequency band noise in a first audio frame, and calculating a pitch estimation of a second audio frame from at least one spectral peak in the second audio frame associated with a frequency above a predefined frequency threshold where low-frequency band noise is present in the first audio frame.

In another aspect of the present invention the detecting step includes determining the spectrum of the first audio frame, calculating a measure $R_{curr}$ of the relative spectral components level in the frequency band $[0, F_c]$ of the first audio frame, where $F_c$ is a predefined threshold value, calculating an integrative measure R of the relative spectral components level in the frequency band $[0, F_c]$ of a plurality of audio frames from the $R_{curr}$ values of each of the plurality of audio frames, and determining that low-frequency band noise is present if $R>R_0$, where $R_0$ is a predefined threshold value.

In another aspect of the present invention the calculating step includes calculating where the predefined threshold value is between about 270 Hz and about 330 Hz.

In another aspect of the present invention the calculating step includes calculating where the predefined threshold value is about 300 Hz.

In another aspect of the present invention the calculating a measure $R_{curr}$ step includes calculating where the predefined threshold value $F_c$ is between about 330 Hz and about 430 Hz.

In another aspect of the present invention the calculating a measure $R_{curr}$ step includes calculating where the predefined threshold value $F_c$ is about 380 Hz.

In another aspect of the present invention the calculating an integrative measure step includes calculating using the formula $R \leftarrow F(R, R_{curr})$.

In another aspect of the present invention the detecting step includes detecting for a non-speech frame.

In another aspect of the present invention the calculating step includes calculating for a speech frame.

In another aspect of the present invention the detecting step includes detecting for the first audio frame that precedes the second audio frame.

In another aspect of the present invention the method further includes detecting whether the first audio frame is a speech frame or a non-speech frame, and where the first detecting step includes detecting where the first audio frame is a non-speech frame.

In another aspect of the present invention a computer program embodied on a computer-readable medium is provided, the computer program including a first code segment operative to detect the presence of low-frequency band noise in a first audio frame, and a second code segment operative to calculate a pitch estimation of a second audio frame from at least one spectral peak in the second audio frame above a predefined threshold where low-frequency band noise is present in the first audio frame.

In another aspect of the present invention the computer program further includes a third code segment operative to cause the second code segment to exclude from the spectrum of the second audio frame at least one low-frequency spectral peak below a predefined threshold where low-frequency band noise is present in the first audio frame.

BRIEF DESCRIPTION OF THE DRAWINGS

The present invention will be understood and appreciated more fully from the following detailed description taken in conjunction with the appended drawings in which.

DETAILED DESCRIPTION OF PREFERRED EMBODIMENTS

In the present invention a digitized audio signal is preferably divided into frames of appropriate duration and relative offset, such as 25 ms and 10 ms respectively, for subsequent processing. Pitch is preferably estimated once for each frame, with the obtained sequence of pitch values being referred to as the pitch contour of the digitized audio signal.

Figure 1:
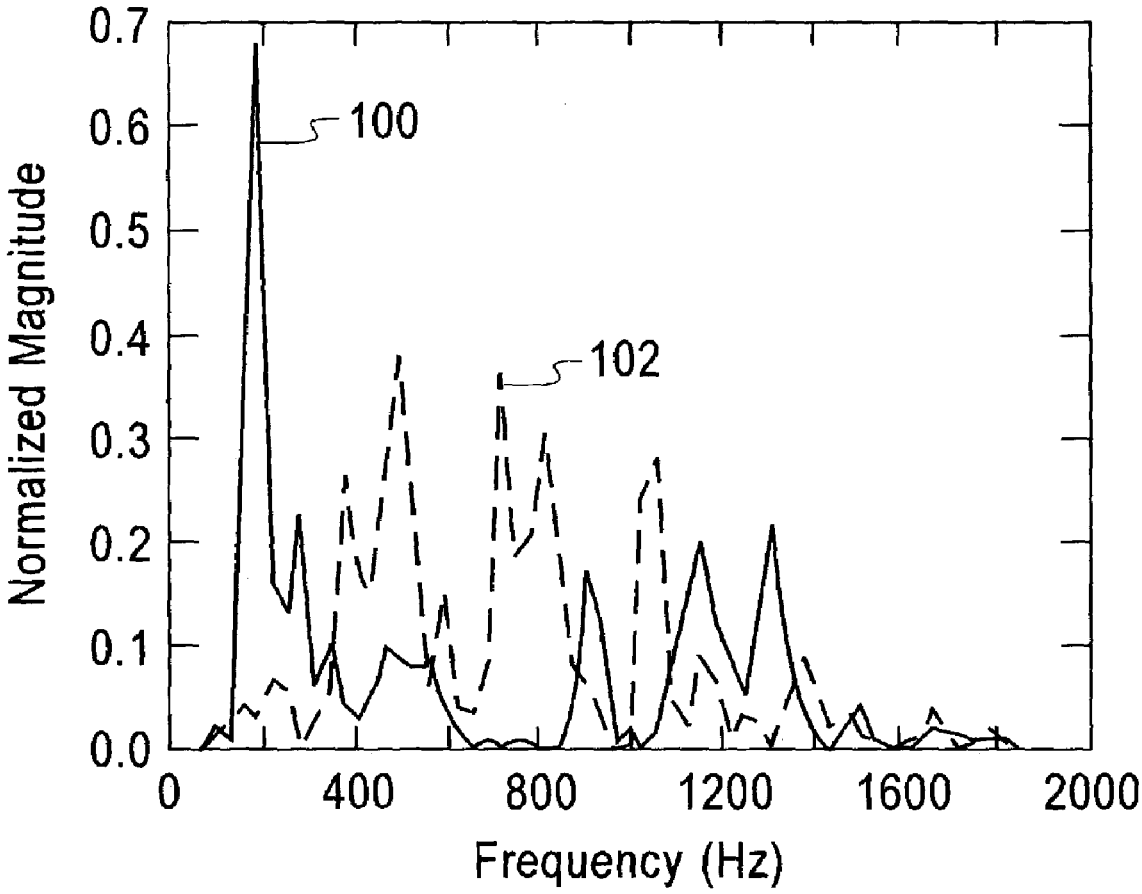
FIG. 1 is a simplified graphical illustration of automobile passenger compartment noise and babble noise spectra, useful in understanding the present invention.

Reference is now made to FIG. 1, which is a simplified graphical illustration of automobile passenger compartment noise and babble noise spectra, useful in understanding the present invention. In FIG. 1 an amplitude spectrum of automobile passenger compartment noise of a moving or idling car is shown as a solid line 100. By contrast, an amplitude spectrum of babble noise of the same intensity is shown as a dashed line 102. It may be seen that the most prominent spectral components of the automobile noise are located below 380 Hz, while most of the babble noise spectrum energy resides above this frequency.

Figure 2A:
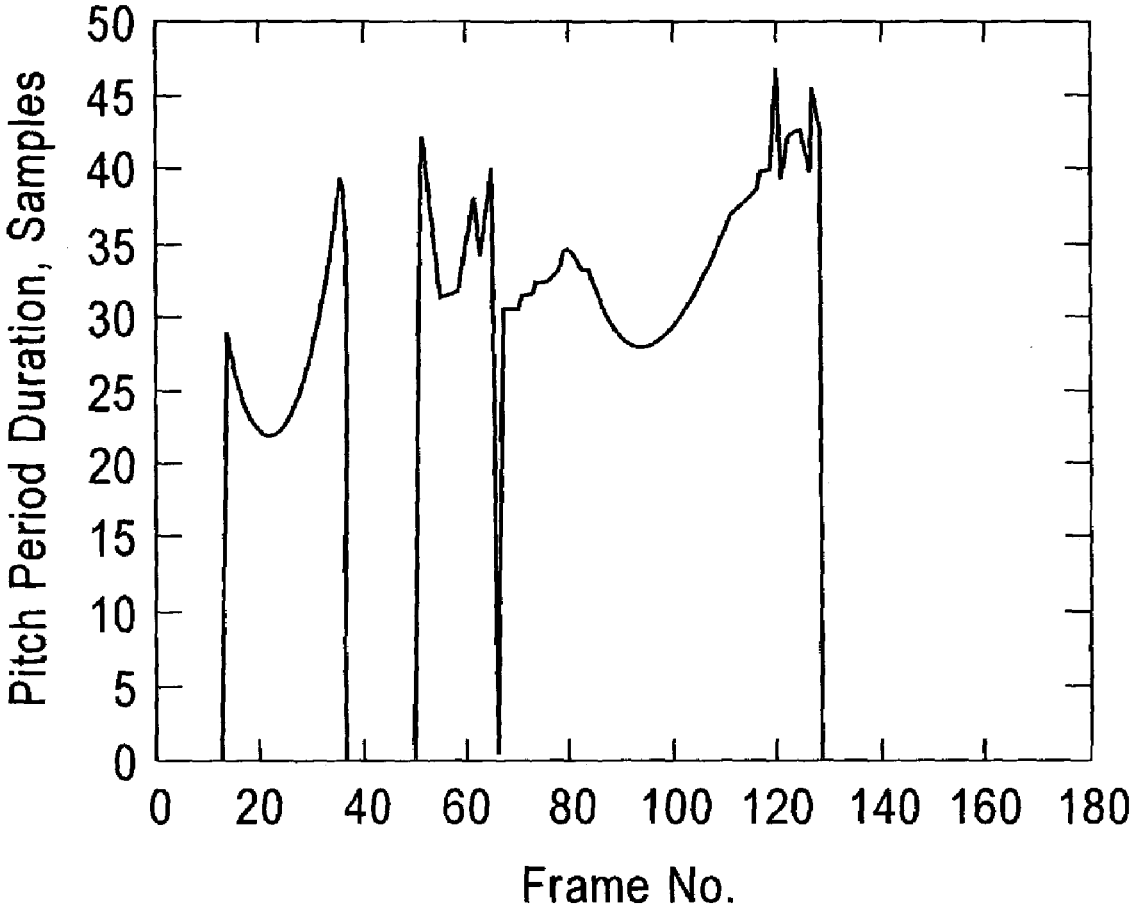
FIGS. 2A, 2B, and 2C are simplified graphical illustrations of pitch contours estimated from, respectively, a clean speech signal, the speech signal plus babble noise, and the speech signal plus automobile noise, useful in understanding the present invention.
Figure 2B:
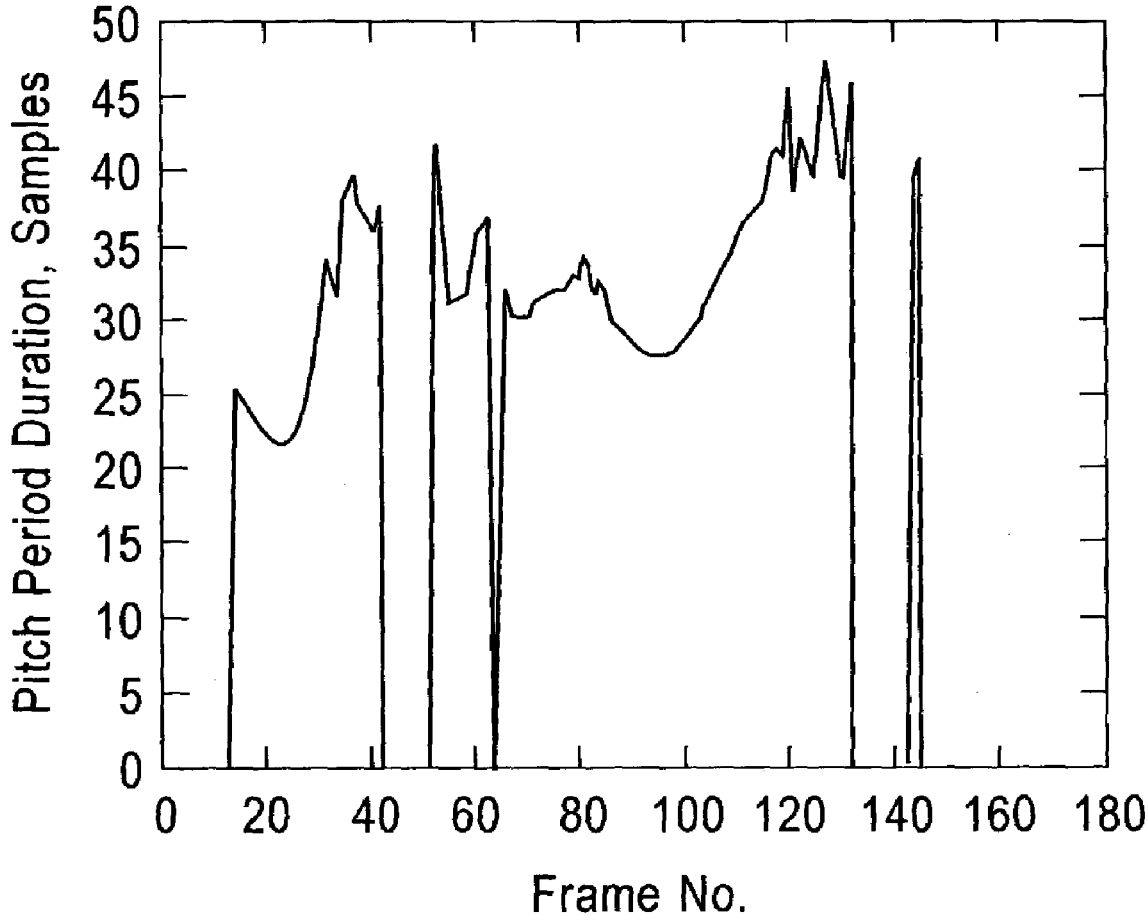
Figure 2C:
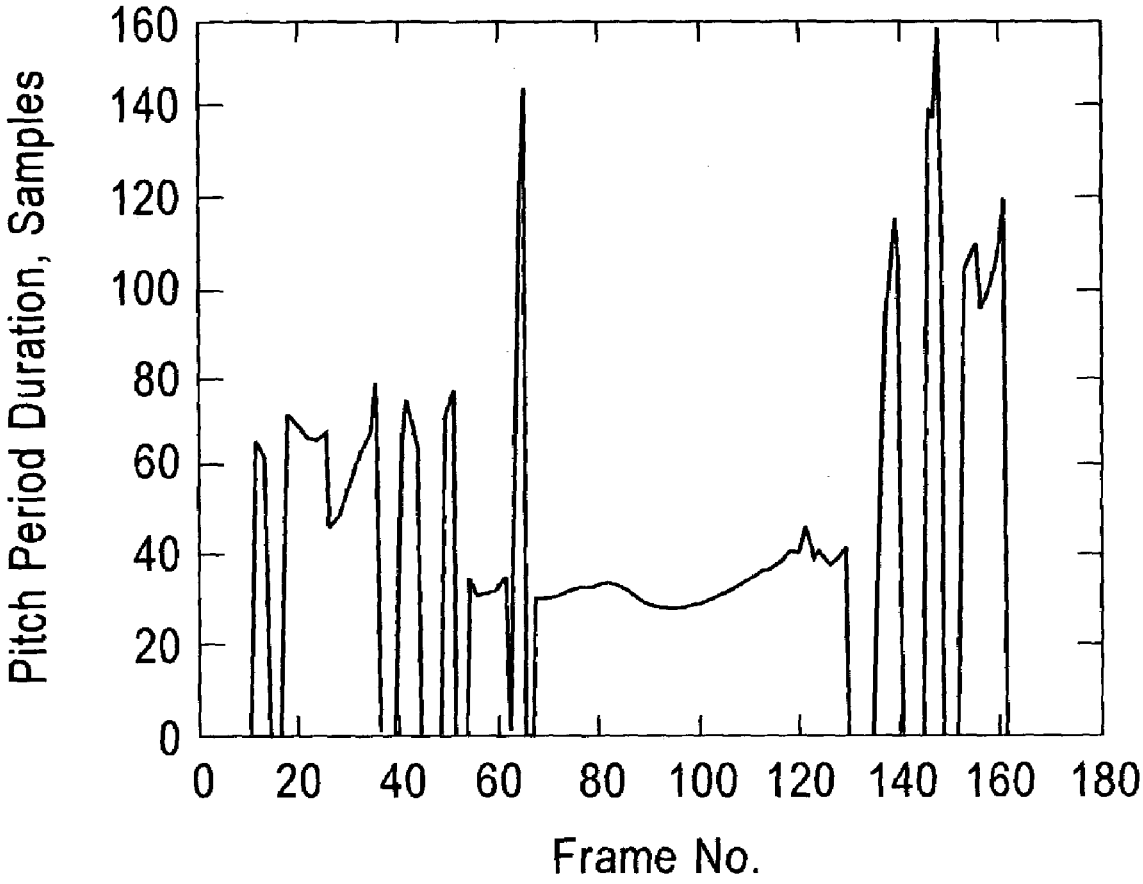

Reference is now made to FIGS. 2A, 2B, and 2C, which are simplified graphical illustrations of pitch contours estimated from, respectively, a clean speech signal, the speech signal plus babble noise, and the speech signal plus automobile noise, useful in understanding the present invention. In FIGS. 2A, 2B, and 2C, pitch is measured in samples corresponding to an 8 KHz sampling rate. Pitch values for unvoiced frames are set to zero. It may be seen in FIG. 2C relative to FIGS. 2A and 2B how pitch estimation accuracy using spectral peaks will be degraded under automobile noise conditions. Gross pitch errors and wrong voiced/unvoiced decisions appear on the pitch contour obtained from the speech signal affected by the background automobile noise.

Figure 3:
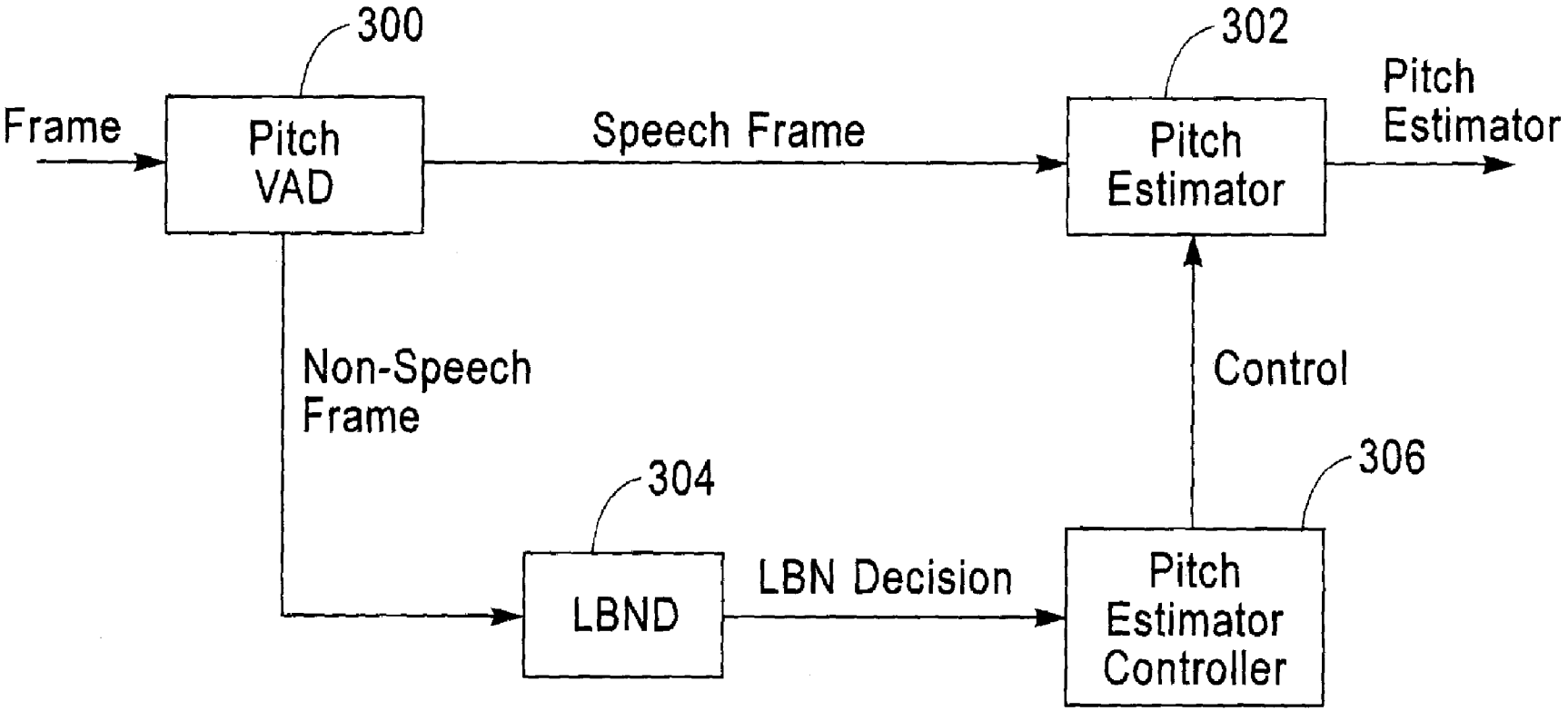
FIG. 3 is a simplified block diagram illustration of a pitch estimation system incorporating a low-frequency band noise detector, constructed and operative in accordance with a preferred embodiment of the present invention.

Reference is now made to FIG. 3, which is a simplified block diagram illustration of a pitch estimation system incorporating a low-frequency band noise detector, constructed and operative in accordance with a preferred embodiment of the present invention. In the system of FIG. 3, one or more frames of an audio stream are received at a voice activity detector (VAD) 300 which detects whether or not a received frame contains speech using conventional techniques, where non-speech frames represent silence or background noise. Speech frames are passed to a pitch estimator 302, which may employ any known frequency-domain pitch estimation method, such as that which is described in U.S. patent application Ser. No. 09/617,582, being assigned to the assignee of the present application.

Non-speech frames are passed to a low-frequency band noise detector (LBND) 304 which determines whether or not low-frequency band noise is present. A preferred method of operation of LBND 304 is described in greater detail hereinbelow with reference to FIG. 4A. LBND 304 then provides a signal to a pitch estimator controller (PEC) 306 indicating whether or not low-frequency band noise is present. PEC 306 then modifies the mode of operation of pitch estimator 302 in accordance with the signal received from LBND 304. A preferred method of operation of PEC 306 is described in greater detail hereinbelow with reference to FIG. 4B.

Figure 4A:
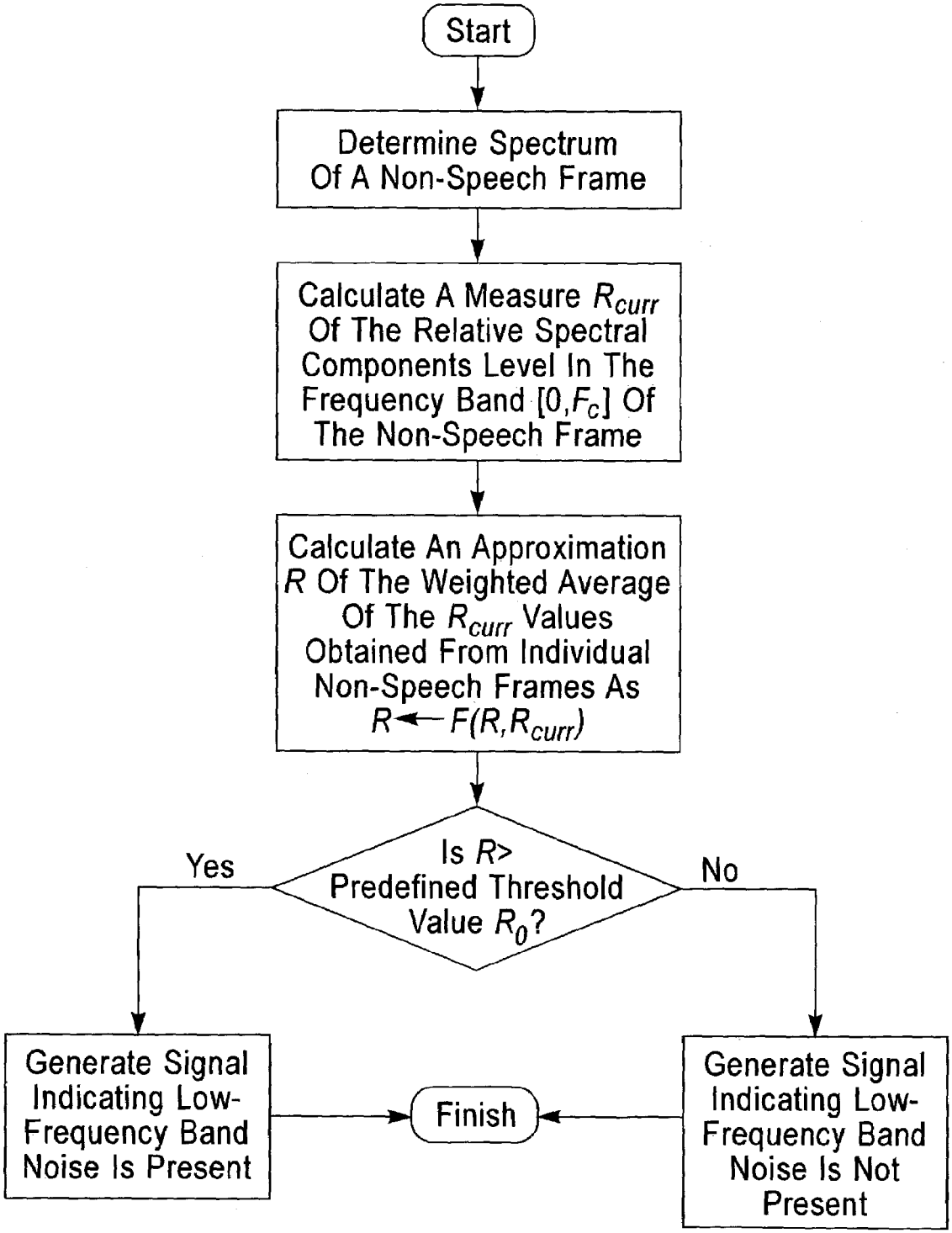
FIG. 4A is a simplified flowchart illustration of a method of operation a low-frequency band noise detector, operative in accordance with a preferred embodiment of the present invention.

Reference is now made to FIG. 4A, which is a simplified flowchart illustration of a method of operation a low-frequency band noise detector, such as LBND 304 of FIG. 3, operative in accordance with a preferred embodiment of the present invention. In the method of FIG. 4 the spectrum of a non-speech frame is determined, and a measure $R_{curr}$ of the relative spectral components level in the frequency band $[0, F_c]$ is calculated, where $F_c$ is a predefined threshold value, such as any value between about 330 Hz and about 430 Hz (e.g., about 380 Hz). A variable R is maintained which is a weighted average of the $R_{curr}$ values obtained from individual non-speech frames. R is an integrative measure of $R_{curr}$ values of multiple non-speech frames, and is preferably updated using the latest $R_{curr}$ value in the formula $R \leftarrow F(R, R_{curr})$. It may be determined that low-frequency band noise is present if $R>R_0$, where $R_0$ is a predefined threshold value, and a signal may be generated indicating whether or not low-frequency band noise is present.

For example, let S(k), k=1, . . . , L be a power spectrum of a non-speech frame sampled at positive FFT frequencies. Let $K_c$ be $F_c$ rounded to the nearest FFT frequency point index. Then $R_{curr}=0$ if $(\Sigma S(k))/L<500$, otherwise $$R_{curr} = \max_{0<k<K_c} S(k) \Big/ \max_{K_c<k<L} S(k).$$

The averaged measure update formula is $R \leftarrow (0.99R+0.01R_{curr})$. The threshold value is $R_0=1.9$. R may be initialized to $R=R_0$.

Figure 4B:
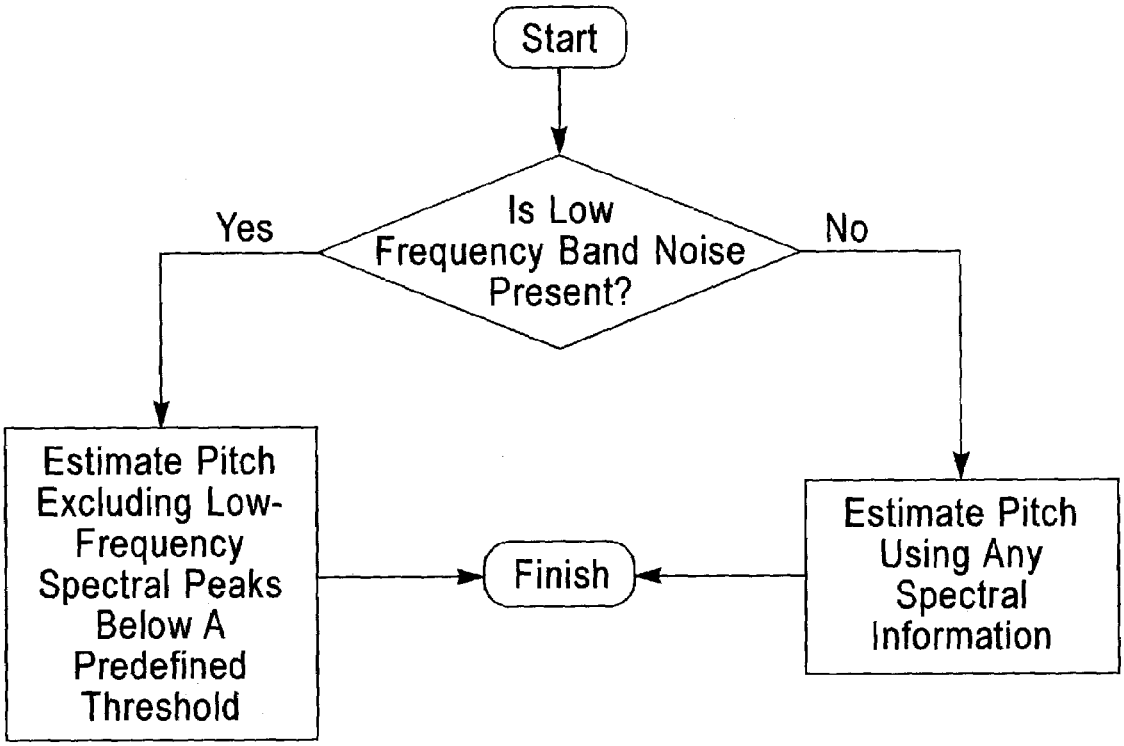
FIG. 4B is a simplified flowchart illustration of a method of operation a pitch estimator controller, operative in accordance with a preferred embodiment of the present invention.

Reference is now made to FIG. 4B, which is a simplified flowchart illustration of a method of operation of a pitch estimator controller, such as PEC 306 of FIG. 3, operative in accordance with a preferred embodiment of the present invention. If no low-frequency band noise has been detected, PEC 306 sets pitch estimator 302 to use any of the spectral peaks of a speech frame in any frequency range in its pitch estimation calculations. Conversely, if low-frequency band noise has been detected, PEC 306 sets pitch estimator 302 to exclude low-frequency spectral peaks below a predefined threshold, such as any value between about 270 Hz and about 330 Hz (e.g., about 300 Hz), from its pitch estimation calculations. Pitch estimator 302 preferably continues to operate in accordance with the most recent settings made by PEC 306 based on the low-frequency band noise analysis of the most recent non-speech frame.

Figure 5A:
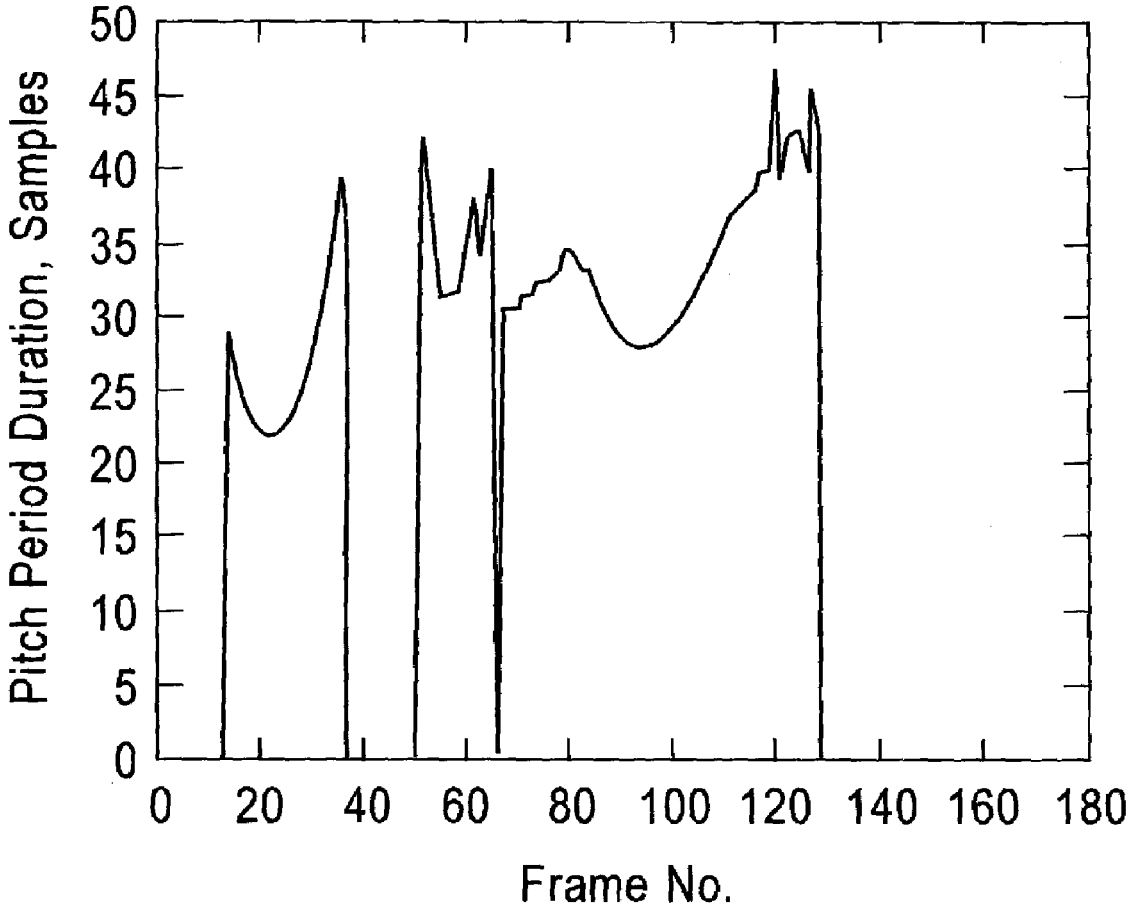
FIGS. 5A, 5B, and 5C are simplified graphical illustrations of pitch contours estimated from, respectively, a clean speech signal, the speech signal plus babble noise, and the speech signal plus automobile noise after application of the present invention.
Figure 5B:
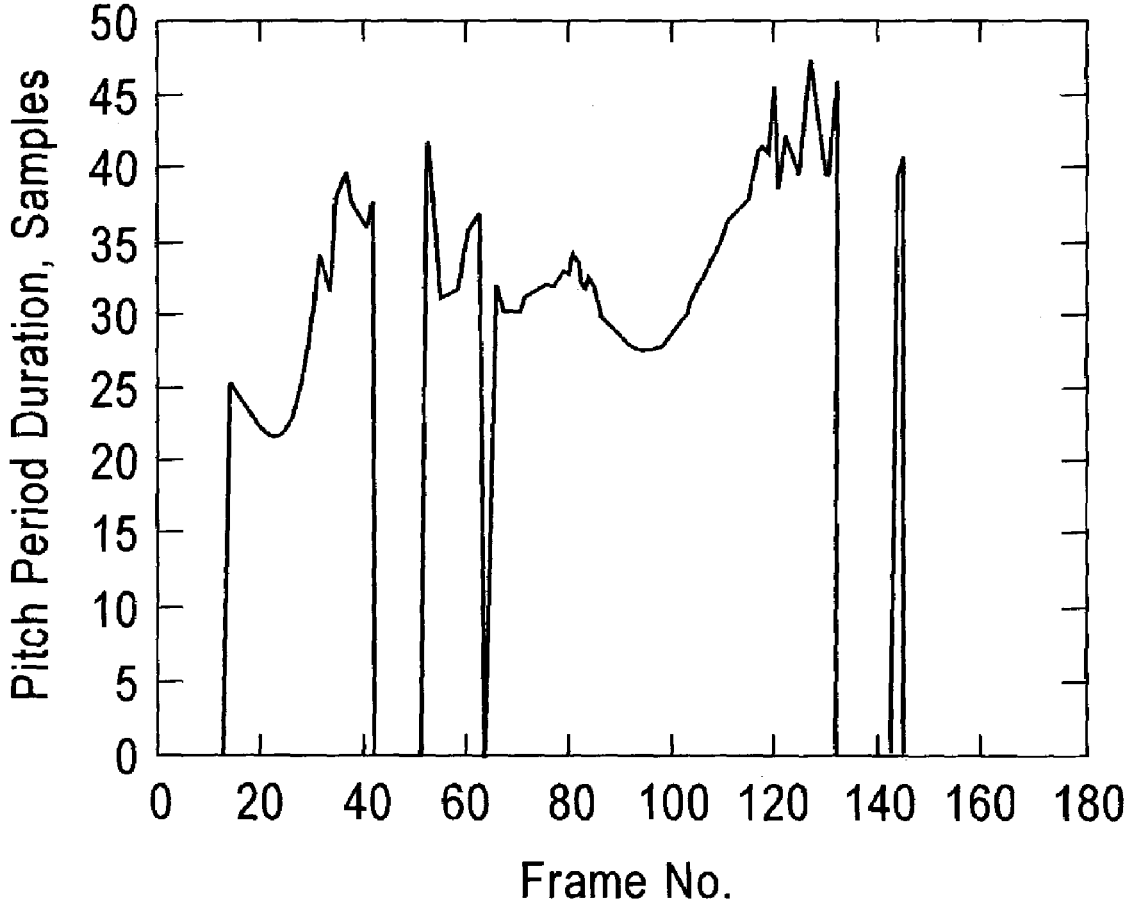
Figure 5C:
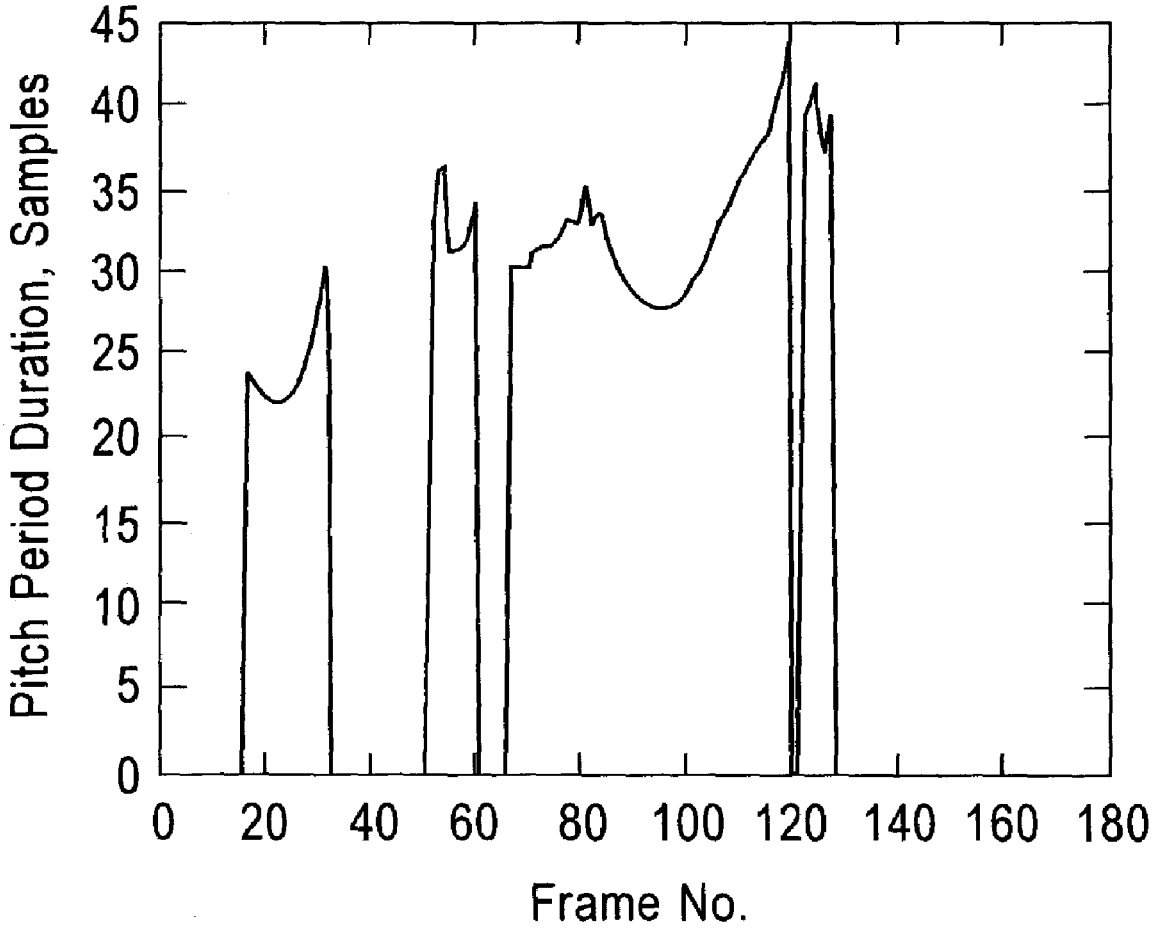

Reference is now made to FIGS. 5A, 5B, and 5C, which are simplified graphical illustrations of pitch contours estimated from, respectively, a clean speech signal, the speech signal plus babble noise, and the speech signal plus automobile noise after application of the present invention, useful in understanding the present invention. FIG. 5C shows how pitch estimation accuracy using spectral peaks may be improved when compared to FIG. 2C by applying the system and method of the present invention. FIG. 5A and FIG. 5B show, when compared to FIG. 2A and FIG. 2B respectively, that high pitch estimation accuracy achieved in absence of low band noise is not significantly affected by applying the system and method of the present invention.

It is appreciated that one or more of the steps of any of the methods described herein may be omitted or carried out in a different order than that shown, without departing from the true spirit and scope of the invention.

While the methods and apparatus disclosed herein may or may not have been described with reference to specific computer hardware or software, it is appreciated that the methods and apparatus described herein may be readily implemented in computer hardware or software using conventional techniques.

While the present invention has been described with reference to one or more specific embodiments, the description is intended to be illustrative of the invention as a whole and is not to be construed as limiting the invention to the embodiments shown. It is appreciated that various modifications may occur to those skilled in the art that, while not specifically shown herein, are nevertheless within the true spirit and scope of the invention.

What is claimed is:

1. A pitch estimation system comprising:

a low-frequency band noise detector (LBND) operative to detect the presence of low-frequency band noise in a first audio frame;

a frequency-domain pitch estimator operative to calculate a pitch estimation of a second audio frame from at least one spectral peak in said second audio frame; and a pitch estimator controller operative in response to said LBND detecting the presence of low-frequency band noise in said first audio frame to cause said pitch estimator to exclude from the spectrum of said second audio frame at least one low-frequency spectral peak located below a predefined frequency threshold, and thereby exclude said low-frequency spectral peak from all operations of said pitch estimator.

2. A system according to claim 1 wherein said LBND is operative to:

determine the magnitude spectrum $S(f_i)$ of said first audio frame in a frequency range $0 \leqq f_i \leqq F_{up}$ where $F_{up}$ is a positive predefined upper frequency value;

calculate a measure of a relative low-band spectral level $R_{curr}=V(0, F_c)/V(F_c, F_{up})$ where $F_c$ is a predefined threshold value $0<F_c<F_{up}$, and V(a,b) is a measure indicative of the level of spectral components $S(f_i)$ inside the frequency band $a \leqq f_i \leqq b$;

calculate an integrative measure R of the relative low band spectral level of a plurality of audio frames from the $R_{curr}$ values of each of said plurality of audio frames; and determine that low-frequency band noise is present if $R>R_0$, where $R_0 0$ is a positive predefined threshold value.

3. A system according to claim 1 wherein said predefined threshold value is about 300 Hz.

4. A system according to claim 2 wherein said predefined threshold value $F_c$ is between about 330 Hz and about 430 Hz.

5. A system according to claim 2 wherein said predefined threshold value $F_c$ is about 380 Hz.

6. A system according to claim 1 wherein said predefined threshold value is between about 270 Hz and about 330 Hz.

7. A system according to claim 2 wherein said integrative measure R is calculated recursively from its value calculated at a preceding frame using the formulas $R_{new}=F(G(R)+H(R_{curr}))$; $R=R_{new}$, where F, G and H are positive monotonous functions.

8. A system according to claim 1 wherein said first audio frame is a non-speech frame.

9. A system according to claim 1 wherein said second audio frame is a speech frame.

10. A system according to claim 1 wherein said first audio frame precedes said second audio frame.

11. A system according to claim 1 and further comprising a voice activity detector (VAD) operative to detect whether said first audio frame is a speech frame or a non-speech frame, and wherein said LBND is operative where said first audio frame is a non-speech frame.

12. A system according to claim 1 wherein said pitch estimator controller is operative to cause said low-frequency spectral peak to be excluded throughout the duration of a pitch estimation calculation performed by said pitch estimator.

13. A pitch estimation method comprising:

detecting the presence of low-frequency band noise in a first audio frame;

excluding from the spectrum of a second audio frame at least one low-frequency spectral peak located below a predefined frequency threshold; and calculating a pitch estimation of said second audio frame from at least one spectral peak in said second audio frame, wherein said excluding step comprises excluding said low-frequency spectral peak from all operations associated with said pitch estimation calculation.

14. A method according to claim 13 wherein said detecting step comprises:

determining the magnitude spectrum $S(f_i)$ of said first audio frame in a frequency range $0 \leqq f_i \leqq F_{up}$ where $F_{up}$ is a positive predefined upper frequency value;

calculating a measure of a relative low-band spectral level $R_{curr}=V(0, F_c)/V(F_c, F_{up})$ where $F_c$ is a predefined threshold value $0<F_c<F_{up}$, and V(a,b) is a measure indicative of the level of spectral components $S(f_i)$ inside the frequency band $a \leqq f_i \leqq b$;

calculating an integrative measure R of the relative low band spectral level of a plurality of audio frames from the $R_{curr}$ values of each of said plurality of audio frames; and determining that low-frequency band noise is present if $R>R_0$, where $R_0>0$ is a positive predefined threshold value.

15. A method according to claim 13 wherein said calculating step comprises calculating where said predefined threshold value is about 300 Hz.

16. A method according to claim 13 wherein said calculating a measure $R_{curr}$ step comprises calculating where said predefined threshold value $F_c$ is between about 330 Hz and about 430 Hz.

17. A method according to claim 14 wherein said calculating a measure $R_{curr}$ step comprises calculating where said predefined threshold value $F_c$ is about 380 Hz.

18. A method according to claim 13 wherein said calculating step comprises calculating where said predefined threshold value is between about 270 Hz and about 330 Hz.

19. A method according to claim 14 wherein said calculating an integrative measure step comprises calculating said integrative measure R is recursively from its value calculated at a preceding frame using the formulas $R_{new}=F(G(R)+H(R_{curr}))$; $R=R_{new}$, where F, G and H are positive monotonous functions.

20. A method according to claim 13 wherein said detecting step comprises detecting for a non-speech frame.

21. A method according to claim 13 wherein said calculating step comprises calculating for a speech frame.

22. A method according to claim 13 wherein said detecting step comprises detecting for said first audio frame that precedes said second audio frame.

23. A method according to claim 13 and further comprising detecting whether said first audio frame is a speech frame or a non-speech frame, and wherein said first detecting step comprises detecting where said first audio frame is a non-speech frame.

24. A system according to claim 13 wherein said excluding step comprises excluding said low-frequency spectral peak throughout the duration of said pitch estimation calculation.

25. A computer program embodied on a computer-readable medium, the computer program comprising:

a first code segment operative to detect the presence of low-frequency band noise in a first audio frame;

a second code segment operative to exclude from the spectrum of a second audio frame at least one low-frequency spectral peak located below a predefined frequency threshold; and a third code segment operative to calculate a pitch estimation of said second audio frame from at least one spectral peak in said second audio frame, wherein said third code segment is operative to exclude said low-frequency spectral peak from all operations associated with said pitch estimation calculation.

* * * * *